US005916408A

United States Patent [19]

Chen

[11] Patent Number: 5,916,408

[45] Date of Patent: Jun. 29, 1999

[54] METHOD FOR MAKING MITTENLIKE BATH SCRUBBER

[76] Inventor: Ching-Chen Chen, No. 1, Lane 147, Sec. 2, Chung San Rd., Yunlin, Chang Hua Hsien, Taiwan

[21] Appl. No.: 08/869,928

[22] Filed: Jun. 5, 1997

[51] Int. Cl.[6] ..... A47K 7/02

[52] U.S. Cl. ..... 156/308.4; 15/227; 300/21

[58] Field of Search ..... 150/308.4; 300/21; 15/227, 229.11, 229.1, 209.1

[56] References Cited

U.S. PATENT DOCUMENTS

| | | | |
|---|---|---|---|
| 4,091,491 | 5/1978 | Hoffman | 15/227 |
| 4,980,943 | 1/1991 | Barber | 15/227 |
| 5,465,452 | 11/1995 | Girardot | 15/229.11 |
| 5,491,864 | 2/1996 | Tuthill | 15/209.1 |
| 5,564,154 | 10/1996 | Cohn | 15/227 |
| 5,709,434 | 1/1998 | Chen | 300/21 |
| 5,758,386 | 6/1998 | Chen | 15/229.11 |

*Primary Examiner*—Daniel Stemmer
*Attorney, Agent, or Firm*—Browdy and Neimark

[57] ABSTRACT

A method for making a mittenlike bath scrubber includes an initial step in which a tubular net is transformed into a wavy net by a heat rolling device. The wavy net is then flattened such that the wavy net has an upper layer and a lower layer. The flattened wavy net has a closed end which is formed by the fusion of the corresponding portions of the upper layer and the lower layer. The flattened wavy net has an open end which is opposite to the closed end and is provided with a strap. The flattened wavy net is turned inside out to become the mittenlike bath scrubber.

8 Claims, 4 Drawing Sheets

METHOD FOR MAKING MITTENLIKE BATH SCRUBBER

FIELD OF THE INVENTION

The present invention relates generally to a bath scrubber for cleaning the skin of a person while the person is taking a bath, and more particularly to a method for making a mittenlike bath scrubber.

BACKGROUND OF THE INVENTION

The bath sponge and the washcloth are commonly used in washing and cleaning a person's body. In addition, the bath net or brush of a plastic material is also used in lieu of the bath sponge or the washcloth. Such conventional bath items as mentioned above are generally not effective in cleaning a bather's body.

SUMMARY OF THE INVENTION

The primary objective of the present invention is to provide a method for making a mittenlike bath scrubber of a plastic net. The mittenlike bath scrubber of the present invention is relatively effective in cleaning the body of a bather in view of the fact that the mittenlike bath scrubber can be firmly moved around the body of the bather by one hand which is put into the bath scrubber.

In keeping with the principle of the present invention, the foregoing objective of the present invention is attained by a method, which includes an initial step in which a netted tubular article of a plastic material is rolled under heat by a rolling device such that the surface of the netted tubular article becomes wavy. The tubular article is then flattened to have an upper layer and a lower layer. The corresponding sides of the upper layer and the lower layer are sealed off to become a closed end while another corresponding sides opposite to the closed end form an open end which is provided with a fastening strap for fastening a hand covered with a mittenlike bath scrubber.

The foregoing objective, features and functions of the present invention will be more readily understood upon a thoughtful deliberation of the following dedailed descriptions of the embodiments of the present invention with reference to the accompanying drawings.

DETAILED DESCRIPTION OF THE INVENTION

Figure 1:
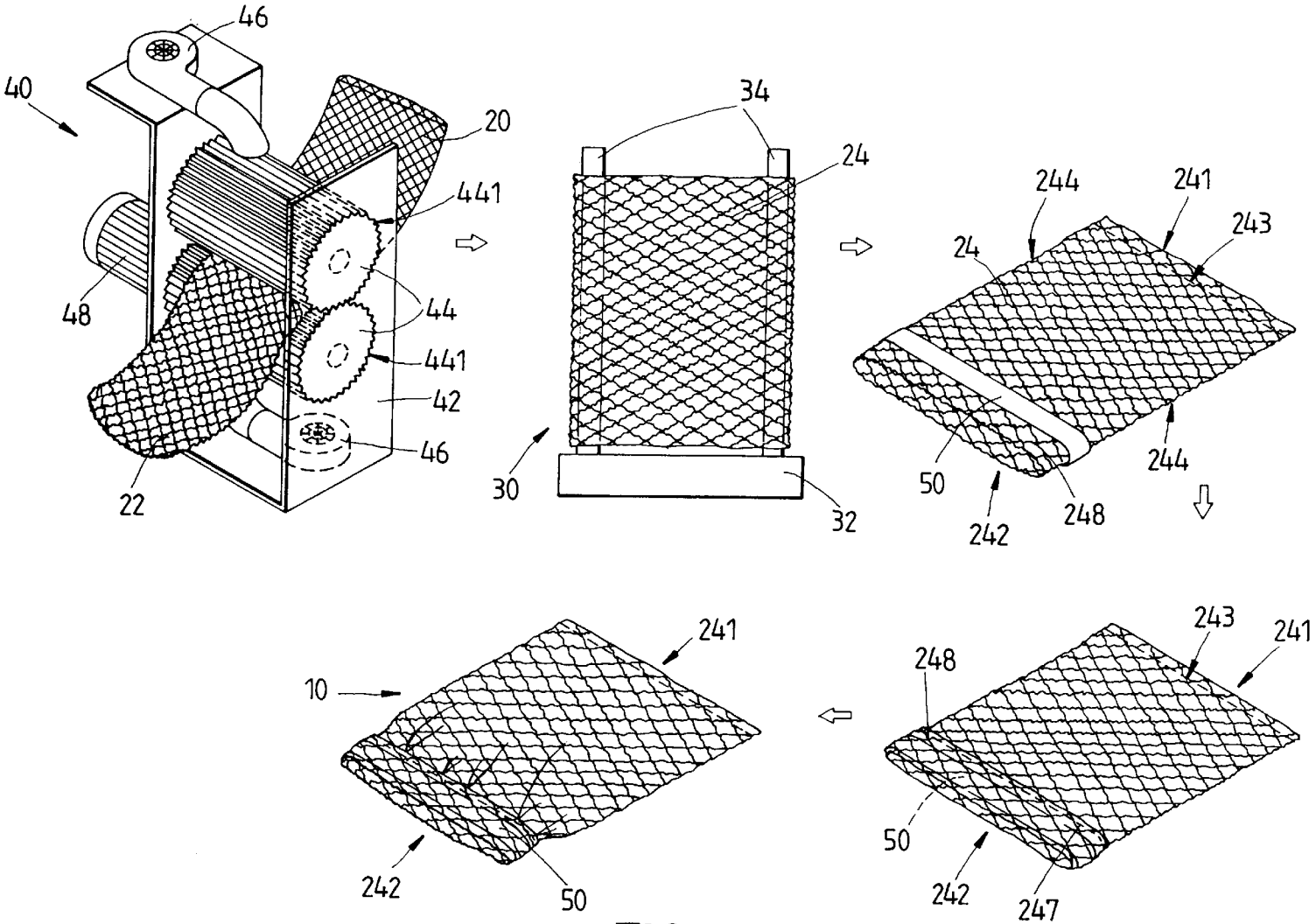
FIG. 1 shows a schematic process flow chart of a first preferred embodiment of the present invention.
Figure 2:
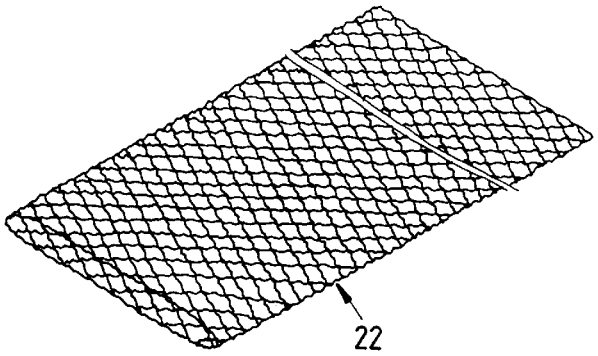
FIG. 2 shows a partial enlarged view of a tubular net of the first preferred embodiment of the present invention.

As shown in FIGS. 1 and 2, a method for making a mittenlike bath scrubber 10 of the present invention consists of the steps which are described explicitly hereinafter.

1. Preparation for materials and equipments:

(a) preparing a tubular net 20 having an appropriate length and an appropriate diameter;

(b) preparing a support frame 30 having a base 32 capable of being mounted on a workbench (not shown in the drawings) such that two support rods 34 of the base 32 are separated by a distance greater than one half of the circumferential length of the unstretched tubular net 20;

(c) preparing a heat rolling device 40, which consists of a support frame 42, two rolling wheels 44 having a plurality of ribs 441 parallel to an axis thereof, two hot air blowers 46, and a motor 48 for driving one of the two rolling wheels 44 which are mounted pivotally on the support frame 42 in such a manner that the ribs 441 of the two rolling wheels 44 are engaged with one another, and that the rolling wheels 44 are corresponding in location to the hot air discharging ports of the hot air blowers 46, and further that the surface temperature of the rolling wheels 44 can be detected by a sensor (not shown in the drawing);

2. Preparation for the finishing of material:

(d) starting the motor 48 and the hot air blowers 46 so as to force two rolling wheels 44 to turn at an appropriate speed such that the surface temperature of the rolling wheels 44 is kept in the range of 50±10° C.;

(e) corrugating the tubular net 20 by means of two rolling wheels 44 such that the tubular net 20 becomes a continuous wavy net 22 extending along the direction of the longitudinal axis of the tubular net 20, as shown in FIG. 2;

3. Preparation for the stacking of material:

(f) using three wavy nets 22 of the step (e);

(g) arranging three wavy nets 22 on two support rods 34 such that the wavy nets 22 are stretched, and that a stacked wavy net 24 is formed, and further that the stacked wavy net 24 is three times thicker than the wavy net 22;

4. Preparation for the forming of a mittenlike bath scrubber:

(h) removing the stacked wavy net 24 from the support rods 34;

(i) flattening the stacked wavy net 24 such that it is composed of an upper layer and a lower layer, and that their margins 244 are joined together, and further that their first connection lines 243 are sewed to form a closed end 241, and still further that an open end 242 is formed at the end opposite to the closed end 241;

5. Preparation for the strapping of the mittenlike bath scrubber:

(j) forming a ring-shaped strap 50 by joining both ends of a strap 50 of an appropriate length;

(k) fitting the ring-shaped strap 50 over the open end 242 of the mittenlike bath scrubber formed in the step (j) such that a folding area 248 is formed between the ring-shaped strap 50 and the margin of the open end 242;

(l) folding the folding area 248 such that the folding area 248 is located outside the strap 50;

(m) sewing the folding area 248 along a second connection line 247 such that the strap 50 is located between the open end 242 and the folding area 248;

6. Preparation for the final finishing of the mittenlike bath scrubber:

(n) carrying out the inside-out process of the mittenlike bath scrubber formed in the step (m) such that seams are concealed in the inside of the mittenlike bath scrubber, and that the final product 10 of the present invention is produced.

The mittenlike bath scrubber 10 of the present invention is more effective in cleaning the body of a person by virtue of the fact that the mittenlike bath scrubber 10 has a contact surface which is formed of the wavy net 22, and that the stacked wavy nets 24 of the mittenlike bath scrubber 10 are joined together only at their margins 244 so as to make the bath scrubber 10 readily expandable to enhance the washing effect of the bath scrubber 10, and further that the bath scrubber 10 can be held securely by a hand which remains in the inside of the bath scrubber 10, and still further that the bath scrubber 10 is provided with the strap 50 for fastening the bath scrubber 10 with the hand of the person taking a bath.

Figure 3:
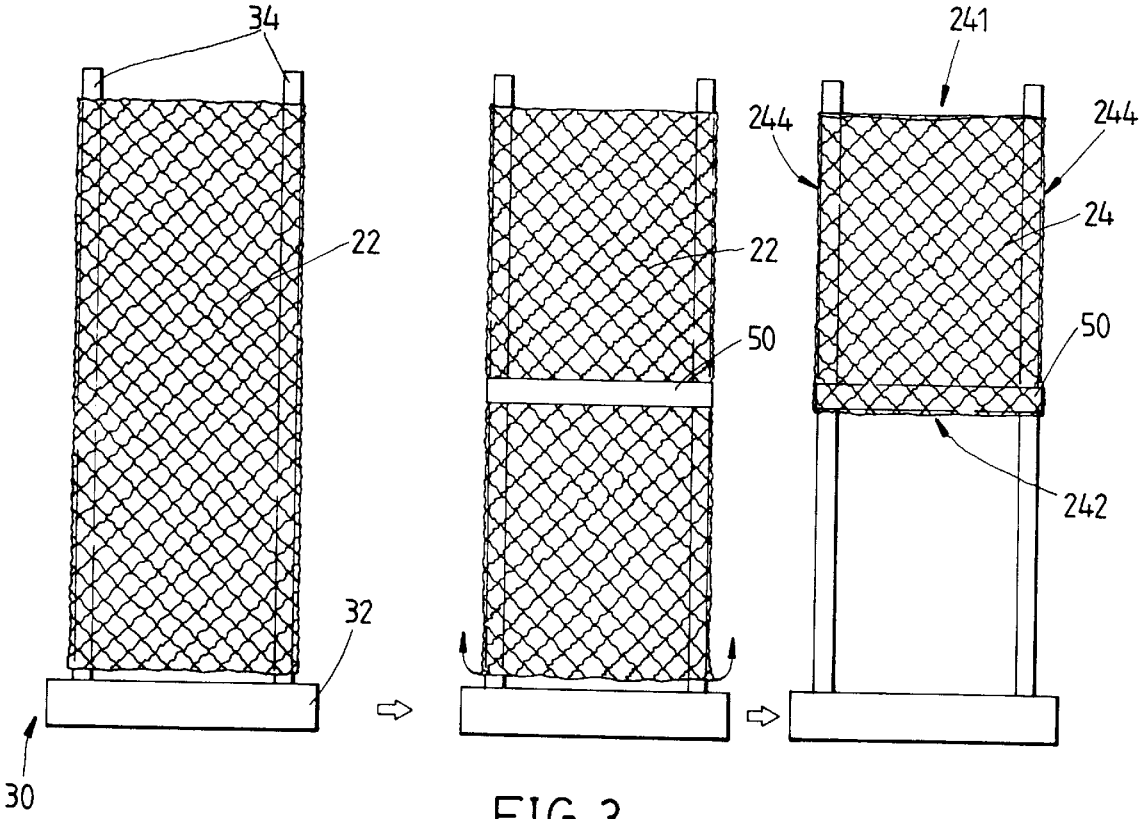
FIG. 3 shows a flow chart of the stacking process of a second preferred embodiment of the present invention.

The stacked wavy net 24 of the present invention may be formed by one or more wavy nets 22 of a greater length, which are arranged on the two support rods 34 such that the lower ends of the wavy nets 22 are turned upwards and inside out, as shown in FIG. 3. The ring-shaped strap 50 is located at the midsegment of the outer edge of the wavy nets 22 before the lower ends of the wavy nets 22 are turned upwards and inside out.

Figure 4:
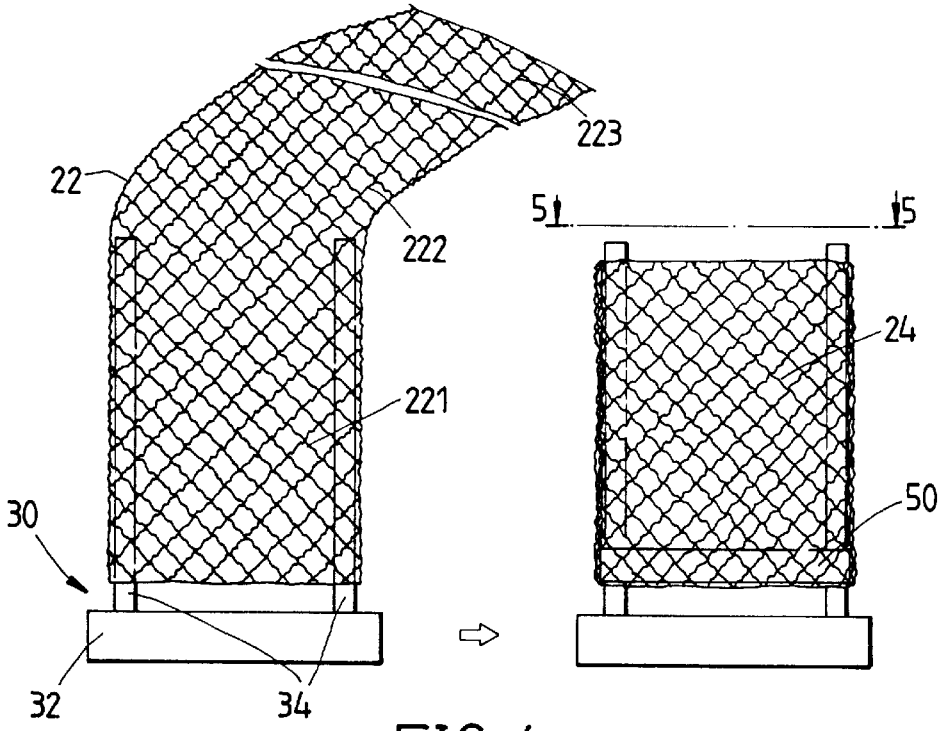
FIG. 4 shows a flow chart of the stacking process of a third preferred embodiment of the present invention.
Figure 5:
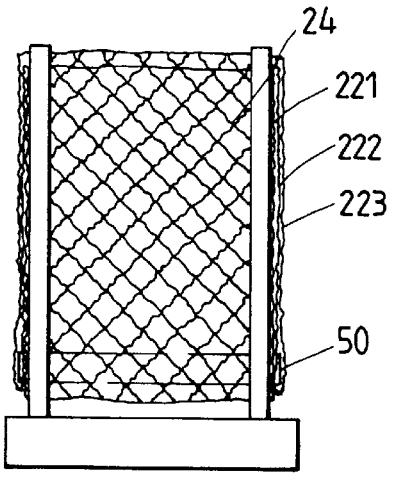
FIG. 5 shows a sectional view taken along the direction indicated by a line 5—5 as shown in FIG. 4.

As shown in FIGS. 4 and 5, the front end 221 of the wavy net 22 is first fitted over the two support rods 34 before the midsegment 222 is turned downwards and inside out such that the upper segment 221 and the midsegment 222 are fitted together, and that the lower segment 223 is turned upwards and inside out, thereby resulting in the formation of the stacked wavy net 24 having three layers formed of the upper segment 221, the midsegment 222 and the lower segment 223 of the wavy net 22. The strap 50 is fitted over the lower segment such that the strap 50 is located at the adjoining portion of the two layers of the stacked wavy nets 24, as shown in FIG. 5. Upon being removed from the support rods 34, the stacked wavy net 24 can be sewed immediately.

Figure 6:
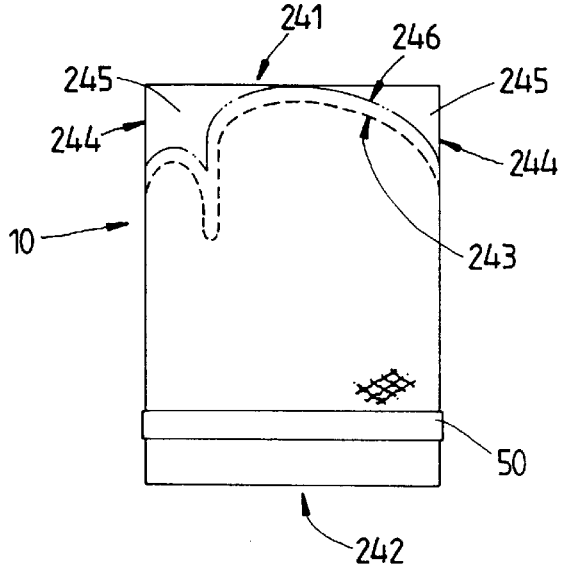
FIG. 6 shows a front schematic view of a fourth preferred embodiment of the present invention.
Figure 7:
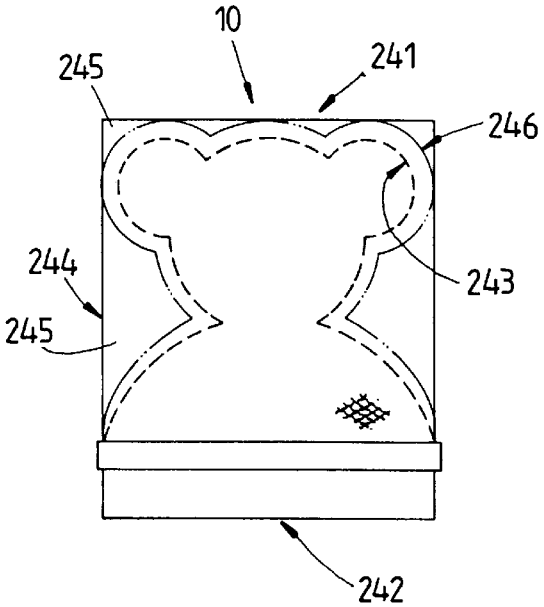
FIG. 7 shows a front schematic view of a fifth preferred embodiment of the present invention.
Figure 8:
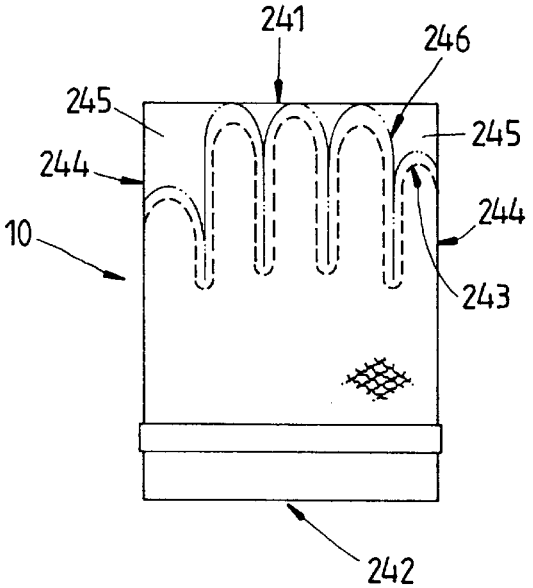
FIG. 8 shows a front schematic view of a sixth preferred embodiment of the present invention.

As shown in FIGS. 6–8, when the closed end 241 is formed by sewing, the sewing may be done along the curved connection line 243 in lieu of a straight line perpendicular to the axis of the stacked wavy net 24, so as to enable the mittenlike bath scrubber 10 of the present invention to have versatile profiles. However, such a bath scrubber 10 as described above has an invalid area 245 which is located between the first connection line 243 and the margin 244 and is capable of obstructing the fingers. As a result, it is necessary to use a cutting tool (not shown in the drawings) to eliminate the invalid area 245 by cutting portion of the invalid area 245 along a cutting line 246 located between the first connection line 243 and the margin 244.

The closed end 241 of the bath scrubber 10 of the present invention may be formed by sewing or heat sealing. The closed end 241 formed by sewing is relatively soft while the closed end 241 formed by heat sealing is relatively hard.

The strap 50 also can be fitting over the open end, after the inside-out process of the mittenlike bath scrubber which do not have to formed the folding area 248.

What is claimed is:

1. A method for making a mittenlike bath scrubber which can be held by a hand inside the scrubber, said method comprising the steps of:

(a) preparing a tubular net having a length and a diameter;

(b) preparing a heat rolling device consisting of a support frame, two rolling wheels mounted on the support frame such that ribs of the rolling wheels are engaged, at least one hot air blower placed on the floor or mounted on the support frame such that the hot air blower faces the rolling wheels, and a motor;

(c) starting the motor such that the rolling wheels are driven to rotate at a predetermined speed, and starting the hot air blower to heat the surfaces of the rolling wheels;

(d) passing the tubular net between the two rolling wheels so as to cause the tubular net to become a wavy net;

(e) stacking a plurality of wavy nets to form a stacked wavy net and flattening stacked the wavy net such that the stacked wavy net has an upper layer and a lower layer, and that the margins of the upper layer and the lower layer of the stacked wavy net are joined together;

(f) fusing the corresponding sides of the upper layer and the lower layer of the flattened wavy net to form a closed end along a first connection line, and forming an open end opposite to the closed end;

(g) preparing a ring-shaped strap;

(h) fitting the ring-shaped strap over the open end such that a folding area is formed between the strap and the edge of the open end;

(i) folding the folding area such that the folding area is located outside the strap;

(j) fastening a portion of the folding area with a portion of the open end such that the strap is located between the open end and the folding area, and that the fastening portion of the folding area and the open end forms a second connection line; and (k) turning the flattened wavy net inside out.

2. The method as defined in claim 1, wherein the process of fusing the corresponding portions of the upper layer and the lower layer of the wavy net and the process of fusing the corresponding portions of the wavy net and the strap are done by sewing.

3. The method as defined in claim 1, wherein the process of fusing the corresponding portions of the upper layer and the lower layer of the wavy net and the process of fusing the corresponding portions of the wavy net and the strap are carried out by heating under pressure.

4. The method as defined in claim 1, wherein the first connection line is extended in a straight direction perpendicular to the axis of the wavy net.

5. The method as defined in claim 1, wherein the first connection line is curved such that a predetermined portion of the first connection line and the edge of the stacked wavy net are separated by a distance, and that an invalid area is formed between the predetermined portion of the first connection line and the edge of the stacked wavy net.

6. The method as defined in claim 5, further comprising a process of cutting the invalid area by means of a cutting tool along a cutting line separated from the first connection line by a distance.

7. A method for making a bath scrubber, said method comprising the steps of:

(a) preparing a tubular net of a length and a diameter;

(b) preparing a support frame provided with two support rods fastened therewith such that the two support rods are opposite to each other at an interval greater than one half of a circumferential length of the tubular net;

(c) preparing a heat rolling device consisting of a support frame, two rolling wheels mounted pivotally on the support frame such that ribs of the two rolling wheels are engaged with each other, at least one hot air blower mounted on the support frame or located on the floor such that the hot air blower faces the rolling wheels, and a motor;

(d) starting the motor such that the rolling wheels are driven to rotate at a predetermined speed, and starting the hot air blower to heat the surfaces of the rolling wheels;

(e) rolling the tubular net between the two rolling wheels so as to cause the tubular net to become a wavy net;

(f) arranging the wavy net on two support rods such that the wavy net is stretched;

(g) preparing a ring-shaped strap;

(h) fitting the ring-shaped strap over a midsegment of the stretched wavy net, and folding one end of the wavy net towards another end of the wavy net by using the strap as a center such that the wavy net becomes tubular in shape and that the strap is enclosed in the tubular wavy net;

(i) removing the tubular wavy net from the support rods;

(j) flattening the tubular wavy net such that the wavy net has an upper layer and a lower layer, and that the margins of the upper layer and the lower layer are joined together;

(k) fusing the corresponding portions of the upper layer and the lower layer of the flattened wavy net so as to form a closed end along a first connection line and has an open end where the strap is located;

(l) fastening the strap near the open end along a second connection line; and (m) turning the flattened wavy net inside out.

8. A method for making a bath scrubber, said method comprising the steps of:

(a) preparing a tubular net having a length and a diameter;

(b) preparing a heat rolling device consisting of a support frame, two rolling wheels mounted on the support frame such that ribs of the rolling wheels are engaged, at least one hot air blower placed on the floor or mounted on the support frame such that the hot air blower faces the rolling wheels, and a motor;

(c) starting the motor such that the rolling wheels are driven to rotate at a predetermined speed, and starting the hot air blower to heat the surfaces of the rolling wheels;

(d) passing the tubular net between the two rolling wheels so as to cause the tubular net to become a wavy net;

(e) arranging a front segment of the wavy net on two support rods;

(f) folding a midsegment of the wavy net towards the front segment;

(g) preparing a ring-shaped strap;

(h) fitting the ring-shaped strap over the folded wavy net adjacent the end of the front segment;

(i) folding a back segment of the folded wavy net towards the midsegment such that the wavy net becomes tubular in shape and that the strap is enclosed in the tubular wavy net;

(j) flattening the tubular wavy net such that the tubular wavy net has an upper layer and a lower layer, and that the margins of the upper layer and the lower layer of the tubular wavy net are joined together;

(k) fusing the corresponding sides of the upper layer and the lower layer of the flattened wavy net to form a closed end along a first connection line, and forming an open end where the strap is located opposite to the closed end; and (l) fastening the strap near the open end along a second connection line.

* * * * *